United States Patent [19]

Roth

[11] Patent Number: 4,745,870

[45] Date of Patent: May 24, 1988

[54] WINDSURFING HARNESS

[76] Inventor: Jon P. Roth, 10 Birch St., Flemington, N.J. 08822

[21] Appl. No.: 89,589

[22] Filed: Aug. 26, 1987

Related U.S. Application Data

[63] Continuation-in-part of Ser. No. 848,811, Apr. 7, 1986, abandoned.

[51] Int. Cl.[4] ..... B63B 35/00

[52] U.S. Cl. ..... 114/39.2; 182/3; 294/15

[58] Field of Search ..... 114/39.1, 39.2, 102, 114/108; 441/114, 68, 74; 182/3–4; 294/15, 17, 25, 26; 272/61, 62, 67, 68, 112

[56] References Cited

U.S. PATENT DOCUMENTS 4,235,182 11/1980 Burger ..... 114/39

FOREIGN PATENT DOCUMENTS 2646923 4/1978 Fed. Rep. of Germany ..... 114/39.2
2464084 4/1981 France ..... 441/114

*Primary Examiner*—Sherman D. Basinger
*Assistant Examiner*—Jesus D. Sotelo
*Attorney, Agent, or Firm*—John G. Gilfillan, III; Raymond J. Lillie

[57] ABSTRACT

A windsurfing harness comprising a cross-shoulder brace, at least two rear-arm support braces to which are attached attachments means such as boom hook straps or gloves. This harness securely holds the windsurfer to the sailboard boom while being easily disengageable from the bottom if necessary.

15 Claims, 4 Drawing Sheets

FIG. 4
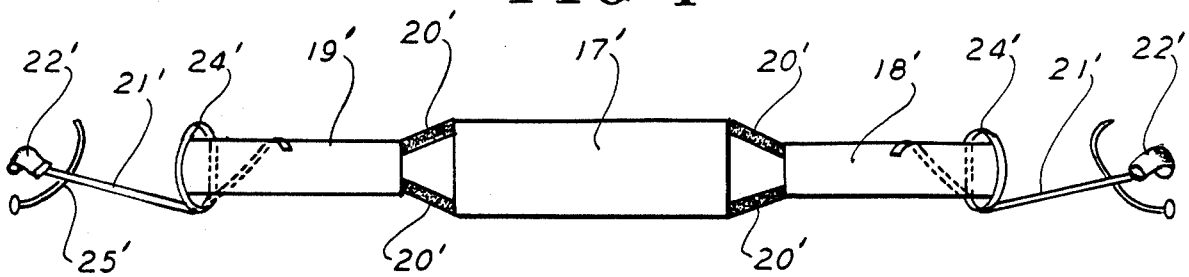
FIG. 5
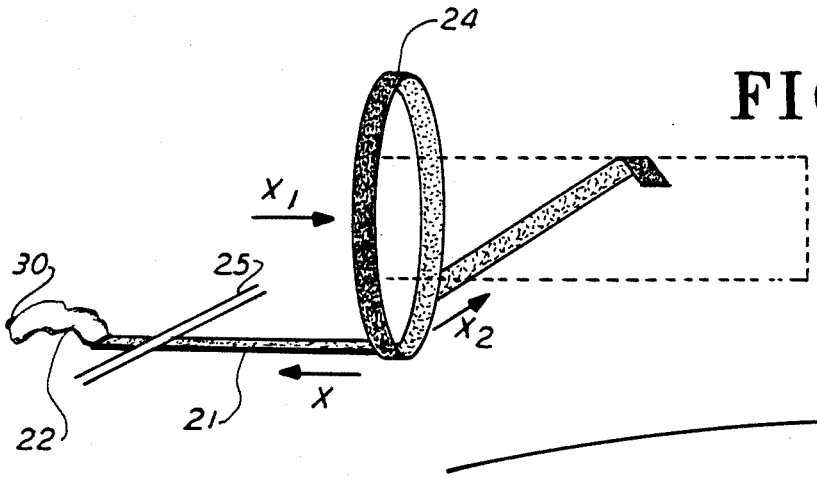
FIG. 6
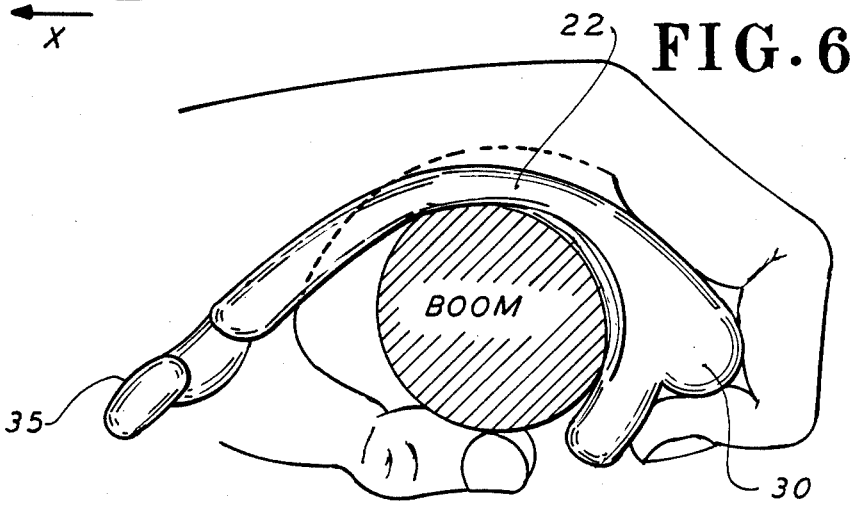
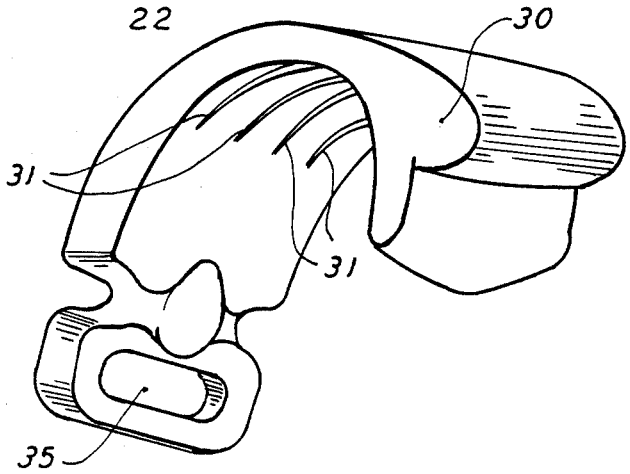
FIG. 7

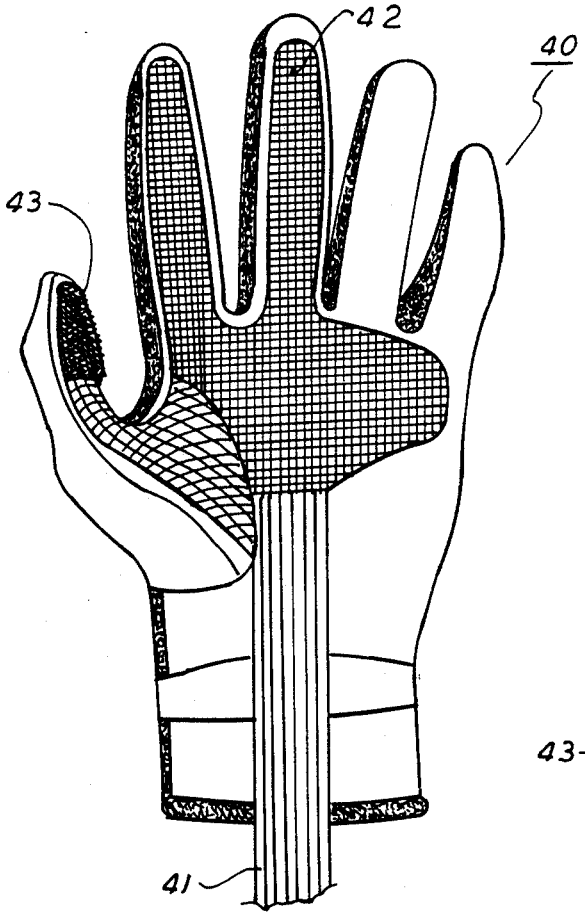
FIG. 12
FIG. 13
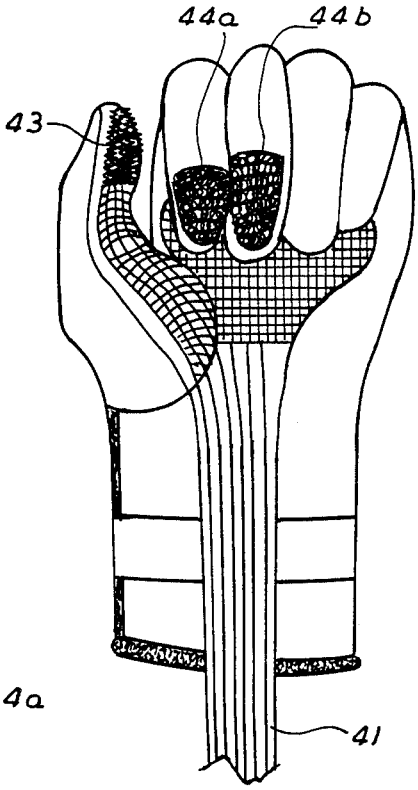
FIG. 14
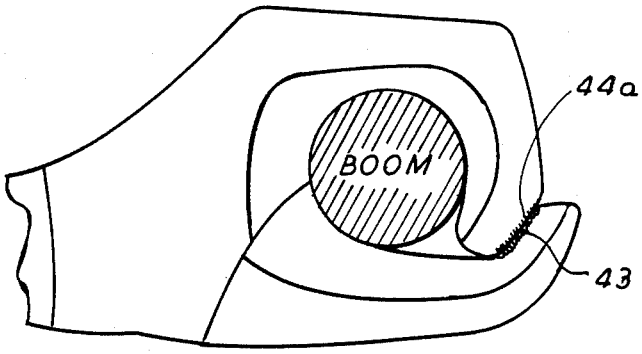

WINDSURFING HARNESS

This Application is a continuation-in-part of application Ser. No. 848,811, filed Apr. 7, 1986, now abandoned.

This invention relates generally to an apparatus and a method of using the apparatus applicable to windsurfing or board sailing.

Prior to the advent of the most modern water sport equipment, surfing became a popular past time, providing enjoyment and excitement for the surfer, who paddled out beyond the breakers in the ocean, and rode the waves toward the shoreline and beach while standing upon the surfboard. This sport has proven to be facinating to watch and to participate in, since it requires a great deal of skill and coordination.

While surfing in this manner has continued to be a popular water sport at shore areas, beach resorts and the like, the disadvantages of surfing are numerous. Because the surfer utilizes waves as his primary means of propelling himself while standing on the surfboard, he may surf only where there are waves sufficiently powerful to propel him. This tends to restrict surfing to a relatively narrow strip off the shoreline where the waves crest and break. Additionally, the surfer can ride the waves for only a short distance since he rapidly approaches the beach area, where the shallowness of the water becomes a limiting factor. Shallow-water waves typically do not provide enough power to propel the surfer standing upon a surfboard, and a surfer may strike the bottom upon falling off of his surfboard.

Windsurfing generally eliminates the above-described disadvantages of surfing, since the windsurfer is not dependent upon wave motion as a means of propulsion, but rather upon the forces of the wind. Additionally, windsurfing can be done at low or high speed, in fresh or salt water and in deep water where wave activity is not predominant.

Windsurfing generally involves an individual or pair of individuals who stand upon the upper flat surface of a sailboard. The sailboard used for windsurfing is generally larger and heavier than a standard surfboard, ranging in length from approximately eight (8) to fourteen (14) feet, and in weight from approximately twenty-five (25) to sixty-five (65) pounds. Further, to propel the sailboard and its user, a vertical mast is utilized, from which a sail is suspended. The mast is typically twelve (12) to sixteen (16) feet tall and supports a sail which ranges from thirty-five (35) to seventy (70) square feet in total area.

To control the direction of the sailboard and to optimize or regulate the speed with which the windsurfer is propelled across the water, the windsurfer holds and controls a boom, or lateral bar-shaped member, which is attached to the mast. By holding and controlling the boom, the windsurfer can maneuver the sail to regulate the extent to which the sail and sailboard are powered by the wind. For example, the windsurfer may increase the speed at which he and the sailboard are travelling by pulling the boom, mast and sail toward the windsurfer, thereby permitting the wind to completely fill the sail. The windsurfer may turn the sailboard downwind by leaning the mast toward the bow of the sailboard causing the sailboard to travel in the direction that the wind is blowing, or upwind by leaning the mast back toward the stern of the sailboard to travel against the wind.

To remain upright on the sailboard, the windsurfer may lean backward, pulling on the boom to utilize his weight to counteract the force of the wind upon the sail. By grasping the boom and leaning backward at the appropriate time, the weight of the windsurfer is supported by the boom, and the mast is maintained in an upright position. However, pulling on and hanging from the boom in this manner can become extremely tiresome when the wind is strong or when the sailboard is used for a long period of time.

The Applicant's invention relates to a harness which is useful for attaching the windsurfer to the boom of a sailboard as described above. In the past, users of sailboards have attached a rope to the boom to form a linking device between the windsurfer and the boom, thereby enabling the windsurfer to control the boom and sail with his weight by leaning backward. Unfortunately, a rope used in this fashion tends to chafe the windsurfer and cannot be quickly disengaged by the windsurfer if the sailboard capsizes. The windsurfer could alternatively wear a harness bearing hook or snap means in the center of the chest which attaches to the rope. The windsurfer can then lean backward to exert his weight to counter the wind force, thereby controlling the direction and speed of the sailboard. The windsurfer thereby remains upright without unduly tiring the windsurfer's hands or arms. Unfortunately, the hook and snap means used in the past were unwieldly and did not release when the windsurfer fell off the sailboard. This failure to release presented a hazardous condition, since the windsurfer could be dragged underwater by the sail and boom, or catapulted from the sailboard by a wave and suddenly yanked forward toward the boom by the harness. Hence, it is important that such a harness be "quick-release" to enable the windsurfer to escape from the sailboard, boom and sail if necessary.

The overall support provided for the windsurfer's weight by a hook or snap located in the center of the chest is inadequate because it is unduly restrictive since the distance between the chest area of the windsurfer and the boom is not easily adjusted. Further, a windsurfer of taller than average height may be required to crouch or stoop unnaturally to enable the hook or snap means to engage the rope attached to the boom, further tiring the windsurfer. These and other disadvantages have been greatly improved upon by the Applicant's invention.

Some windsurfing harnesses have two hooks for attachment of the harness to the boom. The supporting straps which usually are used to connect the harness to the boom via the boom hooks or other attachment means, generally run along the insides or undersides of the windsurfer's arms. This limits the windsurfer to a specific distance from the boom if he desires support from the harness. Alternatively, if support straps are located on the outside of the windsurfer's arms, natural forces exerted on the support straps while surfing can cause the support straps to shift or twist to the insides or undersides of the windsurfer's arms. Therefore, there is a need for a windsurfing harness which will maintain the support straps in a stable position on the outsides of the windsurfer's arms.

The Applicant's invention encompasses a novel harness for attaching a windsurfer to the boom of a sailboard.

Applicant's invention further encompasses a windsurfing harness which attaches to the boom by a plurality of attachment means, said attachment means suitable for placement on the boom and retention within the windsurfer's hands during use.

Applicant's invention further encompasses a windsurfing harness which is essentially a quick release harness, such that the windsurfer can rapidly disengage the harness from the boom, in the event that the sailboard, sail and boom are capsized by the wind, so that he is not pulled over into the water by the sailboard mast, boom and sail.

Applicant's invention further encompasses the use of a plurality of attachment means which serve to attach the harness to the boom, cradling the windsurfer, thereby alleviating the use of friction attachment means and the hand and arm fatigue resulting when the windsurfer's weight is supported largely by his grip upon the boom as he leans backward away from the boom and sail.

Applicant's invention further encompasses a novel jacket means by which the harness is attached to and supports the windsurfer, said jacket means serving as support for the harness. The harness may further be comprised of a plurality of rear arm support braces, two force rotation assemblies, at least one cross-shoulder brace, a different plurality of wrist attachment straps, lower back support means, and means for attaching the harness to the boom.

In one embodiment, each force rotating assembly comprises at least one force redirect strap attached to at least one forearm reinforcement or support strap. The attachments means may comprise a pair of hooks. In a preferred embodiment, these hooks include a knob on the top surface of the hook. This knob enables one to release the hook from the boom as quickly as possible should one desire to detach the hook from the boom. The hooks may also be retractable within hook retraction rings which are capable of surrounding the forearm as well as the hook and the forearm reinforcement strap. In another preferred embodiment, the hook includes at least one ridge protruding from the undersurface of the hooks. The ridge or ridges prevent sliding or slipping of the hook along the boom. The undersurface of the hook preferably is of a double concave design with a V-shaped protrusion between the two concavities.

In another alternative embodiment, the attachment means are in the form of a pair of gloves which engage the boom. Each glove comprises a top surface and an undersurface, and finger portions. The undersurface, or palm of the glove is preferably comprised of a flexible rubber material adapted for gripping. At least a portion of the undersurface of the thumb portion and at least a portion of the top surface of at least one of the other finger portions is covered with a hook and pile closure means such as VELCRO ®, said hook and pile closure means of the thumb portion being capable of engaging the hook and pile closure means of at least one of the other finger portions, thereby aiding in attaching said glove to said boom. The glove may also have a strap means for attachment to the force rotation assembly.

These and other aspects and advantages of the Applicant's invention will become obvious to those skilled in the art from the teachings herein, taken in conjunction with the accompanying drawings in which:

FIG. 4 is an alternative embodiment of the invention without incorporating the jacket means;

FIG. 5 is a side view of an embodiment of the force rotation assembly of the present invention;

FIG. 6 is a side view of an embodiment of a hook of the present invention attached to a boom;

FIG. 7 is a front isometric view of a hook;

FIG. 12 is a view of the underside of a glove in accordance with the present invention;

FIG. 13 is a view of a glove of the present invention showing the hook and pile closures; and FIG. 14 is a side view of a glove of the present invention gripping a boom.

Figure 1:
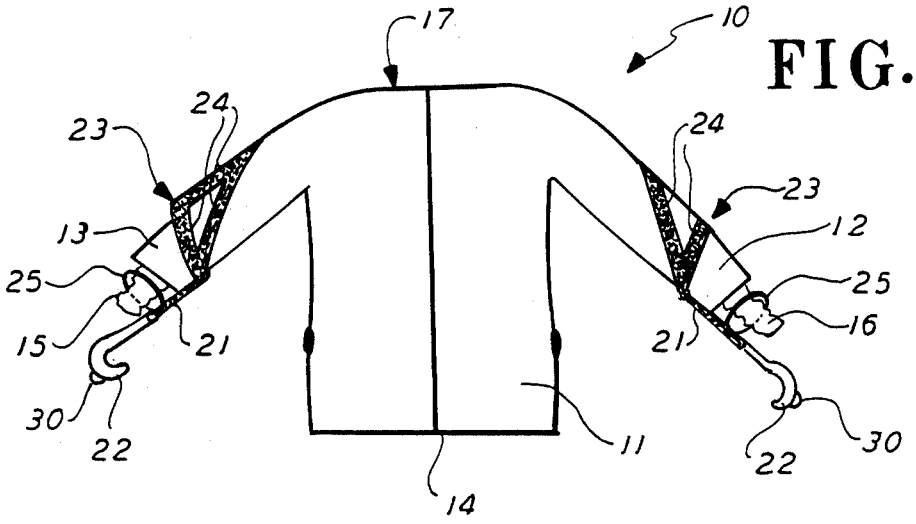
FIG. 1 is a perspective frontal view of the invention.
Figure 2:
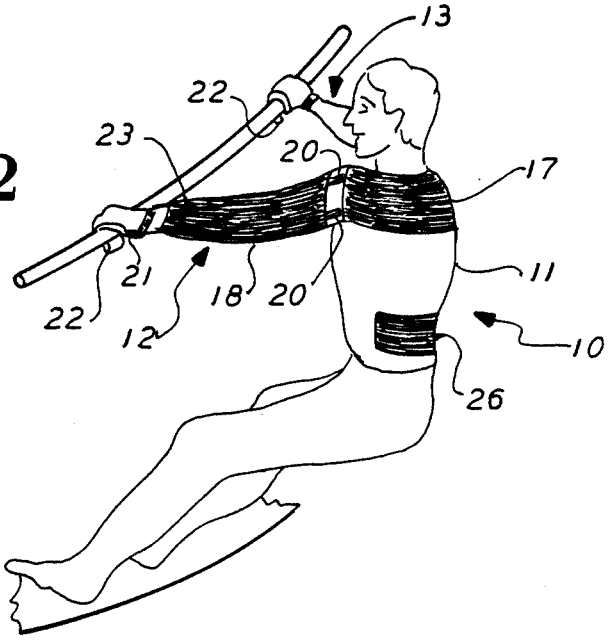
FIG. 2 is a side perspective view.
Figure 3:
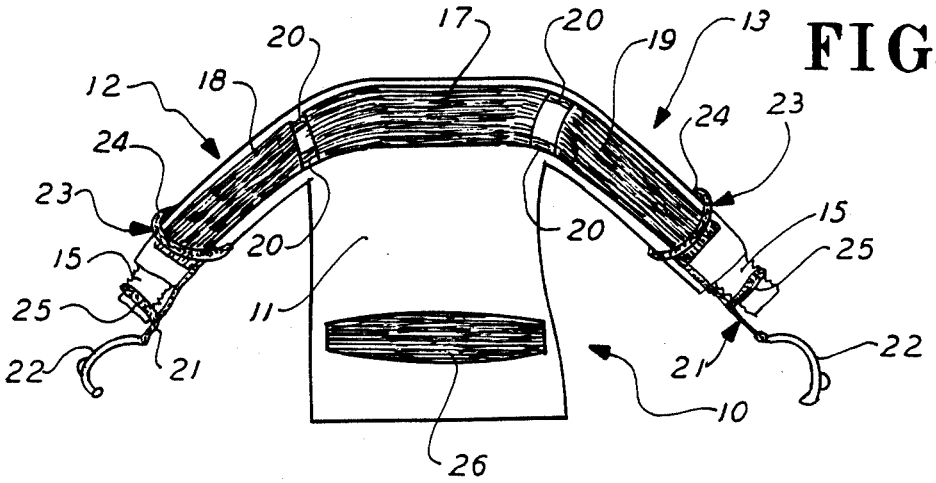
FIG. 3 is a rear view of the invention.
Figure 8:
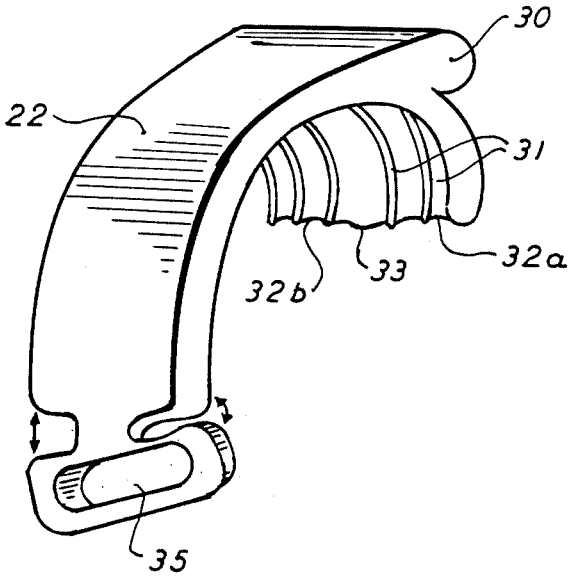
FIG. 8 is a rear isometric view of a hook.
Figure 9:
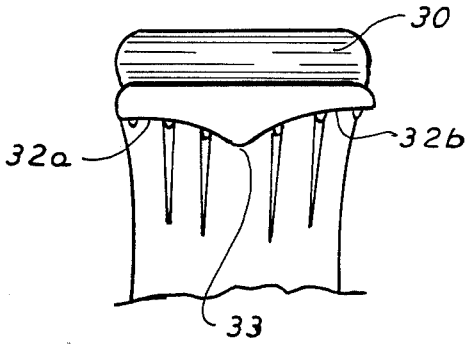
FIG. 9 is a front head on view of a hook.

Referring in detail to the drawings, the windsurfing harness designated generally as 10 may comprise a jacket means 11 having a pair of sleeves 12 and 13. The jacket means may be comprised of any acceptable material such as nylon, cotton, neoprene, rubberized or waterproofed material and the like. By utilizing a waterproof material, the jacket means may effectively preclude water from contacting the upper torso of the windsurfer, thereby keeping the windsurfer warm. Alternatively, the material may be light and non-absorbent to minimize the "wet weight" of the jacket means after it is soaked with water. The material comprising the jacket means should be relatively durable, as well as resistant to wear and tear and fabric fatigue due to prolonged and repeated exposure to fresh or salt water.

The jacket means may further be comprised of a zipper 14 if necessary to enable the windsurfer to place the jacket means upon his upper torso. The zipper may alternatively be replaced with a plurality of fasteners, snaps, buttons or the like, sufficient to secure the respective front portions of the jacket means. However, whichever fastener is chosen need not be so strong as to endure excessive tensional pressure, since the forces generated during windsurfing are transferred largely to the straps and braces described below rather than excessively pulling upon the fasteners. Alternatively, if the jacket means is comprised of stretchable material, such as neoprene rubber, the fastener means may be unnecessary and eliminated.

The jacket means may be long sleeved, and the sleeves 12 and 13 may be comprised of the same material as the torso covering portion of the jacket means, or may be comprised of a different material if required or preferred. The sleeves may run essentially the length of the arms or may be shortened to "short sleeve length." If a short sleeve jacket means is used, the plurality of forearm straps and wristlet straps described below may dangle from the short sleeve portions of the jacket means during non-use.

For use with a long sleeve jacket means, a pair of wrist closures 15 and 16 may similarly be comprised of the same material as the jacket means and sleeves, or may be comprised of a different material. The wrist closures may be elasticized to prevent the sleeves from riding up the arms of the user while windsurfing. The jacket means, sleeves and wrist closures should optimally be comprised of material to which braces and straps can be attached.

The braces and straps attached to the jacket means may be of any material suitable for supporting the windsurfer as he leans back and away from the boom to direct the sailboard. For example, dense fabrics such as tightly woven nylon, polypropylene and light canvas are optimal. The straps and braces may be padded to increase the comfort of the windsurfer and to prevent abrasion or chafing during use.

Across the shoulders of the jacket means may be a cross-shoulder brace 17. The cross-shoulder brace may be sewn or otherwise attached to the jacket means and serves to cradle the shoulders and upper back region of the user during windsurfing.

Further supporting the windsurfer as he operates the sailboard may be a pair of rear-arm support braces 18 and 19, respectively. As described with respect to the cross-shoulder brace, rear-arm support braces are used to cradle the windsurfer during operation of the sailboard. The rear-arm support braces may be attached to the jacket means on the rearward surface of the sleeves thereby providing support for the arms of the windsurfer during use.

Attaching the rear-arm support braces to the cross-shoulder brace may be a plurality of connector straps 20. The plurality of connector straps serves to transfer the forces generated by the wind during operation of the sailboard from the rear-arm support braces to the cross-shoulder brace, thereby providing support for the shoulders and back of the windsurfer. The connector straps may be fixedly attached to the rear-arm support braces and to the cross-shoulder brace without binding or attaching to the jacket means between said braces. In this manner, maximum comfort and flexibility are maintained during windsurfing while providing complete support for the arms, shoulders and back of the windsurfer as he leans away from the boom to control the sailboard.

Attached to each rear-arm support brace generally in the region of the forearms may be at least one boom hook strap 21 which serves to connect each rear-arm support brace to at least one boom hook means 22 and also serves as a forearm reinforcement strap. Each boom hook strap is affixed to a rear-arm support brace in the general wrist area 23 and serves to transfer the force from the boom hook means to the rear-arm support brace. The boom hook straps may be comprised of the same material as the connector straps and the support braces.

To assist in the transfer of force and to assist the windsurfer further in control of the boom, force rotation assembles in the form of force redirect straps 24 and boom hook strap 21 may be incorporated in the general area of each forearm of the jacket means. The force redirect straps assist the windsurfer in easily and comfortably controlling the boom. Further, the force redirect straps may prevent or hinder twisting of the sleeves of the jacket means during use. While maintaining hook stability, the force redirect straps may further allow the windsurfer to slide the hooks along the boom during use without removing the support braces from the optimal support positions. The straps further enable the windsurfer to flex or bend his elbows during windsurfing, thereby allowing him to reflexively adjust his position relative to the boom to compensate for wind gusts. This may be accomplished without losing support provided by the support braces.

The force rotation assembly shown in a preferred embodiment as force redirect strap 24, and boom hook or forearm reinforcement strap 21, is able to direct the forces so that the stability of the harness and the windsurfer is always maintained. As shown in FIG. 5, the force X exerted by the boom hook 30 is rotated to the desired position $X_1$ by the introduction of another force $X_2$. Force $X_1$ travels along the outside of the windsurfer's arm. In other words, the force X which is in the direction of the boom hook 30, is offset by force $X_2$ which is in a direction toward the windsurfer's body, thereby providing the sum of these forces, known as $X_1$, which travels on the outside of the windsurfer's arm, thereby providing the desired stability for the harness and the windsurfer.

A plurality of wristlet straps 25 may be utilized to place each boom hook means within easy grasping distance of the windsurfer during use. Each wristlet strap encircles a wrist of the user, and attaches a boom hook strap to the user's wrist to bring a boom hook means in close proximity to the windsurfer's hand. One means of attaching the wristlet straps to the wrist of the windsurfer would be through the use of a hook and pile patch attachment, such as Velcro ®. By attaching each wristlet strap to a wrist of the user, each boom hook means may be grasped by the windsurfer during use and released for swimming purposes or to disengage from the boom.

To provide further support for the windsurfer, the jacket means may incorporate a low back support means 26, useful for further enabling the windsurfer to control the forces generated through the boom during windsurfing.

Each of the braces and straps described above may be permanently attached to the jacket means or alternatively, may be attached through the use of fastening devices, such as using a plurality of buttons, snaps, hook and pile patch arrangements and the like. In this manner, the braces and straps may be removed from the jacket as a single harness arrangement for replacement, repair, alteration or cleaning.

To utilize the Applicant's invention for windsurfing, the jacket means is placed over the upper torso of the windsurfer, the wristlet straps are wrapped around and attached to each respective wrist area of the windsurfer, and each boom hook means is placed in the corresponding hand of the windsurfer. While standing on the sailboard, the windsurfer attaches each boom hook means to the boom of the sailboard by merely placing said boom hook means over the boom. The user may maintain slight pressure on the top of each boom hook means with the fingers or palm of each hand if he prefers, to maintain the connection between each boom hook means and the boom without unduly tiring the hands or arms of the windsurfer. However, it is to be understood that the windsurfer need not exert any finger or palm pressure on the boom hook means to keep the hook means in place while sailing. The hands may be completely at rest, draped over the hooks means in a relaxed mode, without losing control of the sailboard. Due to the semi-flexible nature of the boom hook means, the windsurfer avoids fatigue in the hands and forearms during windsurfing.

The windsurfer may easily control the forces generated by the boom during operation of the sailboard by leaning backward to exert counteracting forces against the boom and sail. The connection between the boom hook means and the boom is maintained by the windsurfer's weight as he leans back against the harness.

If the windsurfer chooses not to lean backward away from the mast and boom, such as during a very mild breeze, the boom hook means remain in a "ready position" on the boom, supported by the boom and the wrist straps. Alternatively the hook means may dangle from the wrist straps, in close proximity to the windsurfer's hands. In the event of a fall from the sailboard, or when the user wishes to disengage each boom hook means from the boom, said boom hook means are easily disengaged by the windsurfer by a simple motion of the hands and wrists while at least two fingers are grasping the quick release knob 30. By slightly lifting his wrists and the arms upward, the boom hook means are allowed to disengage from the boom. Disengaging the boom hook means during a fall requires an instantaneous reflexive action, whereby the windsurfer may grasp the release knob 30 located on top surface of each boom hook means and flick his wrists backward, thereby instantaneously disengaging the boom hook means 22 from the boom, and thereby becoming completely free of the sailing apparatus.

The underside of the boom hook 22 may have traction ridges 31 which protrude from the underside of boom hook 22 and are capable of gripping a rubber covering which is often used on sailboard booms. At the rear of the hook 22 is a flexible supporting strap ring 35 which is connected to the remainder of the harness by means of support strap 21.

The underside of the boom hook is in the form of a double concave design with a V-shaped projection 33 bifurcating the two concavities 32*a* and 32*b*. The V-shaped projection 33 allows the windsurfer to move and reposition his hands while windsurfing. Because the windsurfer must move one hand at a time in order to maintain control of the rigging, a slight, lateral rocking motion is sufficient to raise the traction ridge 31 from the boom covering and to slide the hook 22 on the V-shaped projection 33 before allowing the traction ridges 31 to grip again.

The boom hook 22, in a preferred embodiment, is connected to the rest of the harness by a support strap 21, and a shock cord 36, which connect the boom hook 22 to the force rotation assembly 24. Surrounding the wrist area is a hook retraction ring 45 into which the hook 22 may be retracted. Hook retraction ring 45 is separate from hook 22. Retraction of the hook 22 into the retraction ring 45 enables greater freedom of hand movement for activities such as swimming, uphauling the rigging from the water, and in attaching the hook 22 to a sailboard boom. When this hook retraction system is used, each boom hook 22 is placed automatically in the corresponding hand of the windsurfer when boom hooks 22 are engaged to the boom.

Figure 10:
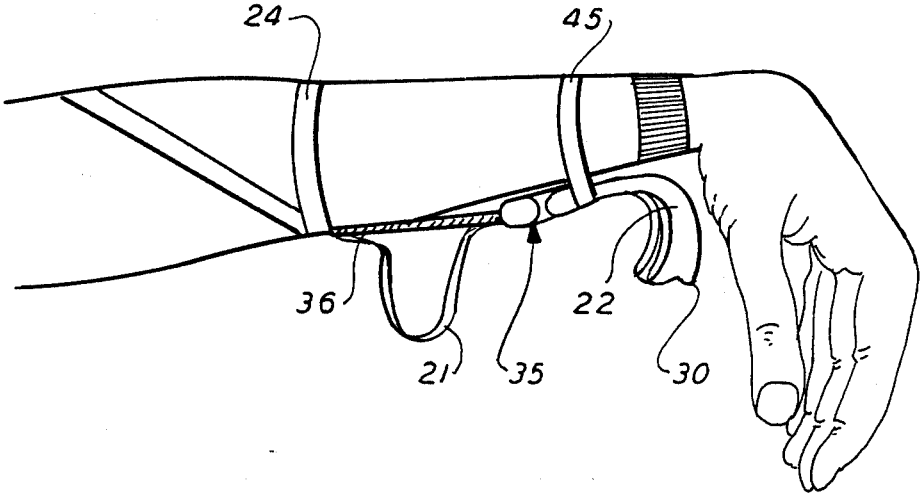
FIG. 10 is a side view of a hook which has been retracted.
Figure 11:
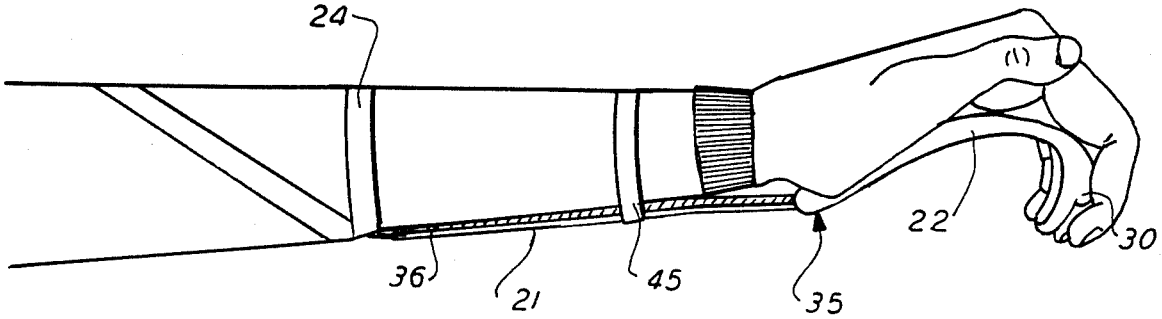
FIG. 11 is a side view of a hook which has been extended and can be used to grip a sail boom.

When the hook 22 is in a retracted position as shown in FIG. 10, it is in the most convenient position from which to attach it to the boom. The windsurfer only needs to make a short, straight, forward motion with the arm directly above and perpendicular to the boom to engage the hook 22 whereby the forward section of support strap 21 will be ready to take up the tension as the shock cord 36 is extended. The hand can then be pulled back so as to rest upon the hook in the sailing position. The entire motion is completed within the space of about five inches.

An alternative attachment means is in the form of a glove 40, as shown in FIGS. 12 to 14. The glove has a palm side 42 which is preferably made of a flexible rubber material and provides traction for the glove 40 when it grabs the boom of a sail board. The glove is connected to the rest of the harness by means of a strap 41 which is also connected to the force rotation assembly or force redirect straps 24.

The glove 40 is provided with a hook and pile closure means made of a material such as VELCRO®. One closure means 43 is located on the underside of the thumb portion of glove 40, while the other closure means are located on the top of the other finger portions. For purposes of illustration only, closure means 44*a* and 44*b* are shown, but any number from one to four closure means may be located on the top of the finger portions.

When one wishes to engage the boom with glove 40, one grips the boom by placing the palm portion 42 on the boom and then engages hook and pile thumb closure 43 with finger closures 44*a* and/or 44*b*. The glove 40 provides a convenient means for engaging a boom. The harness is automatically engaged when the windsurfer grasps the boom and automatically released when the windsurfer opens his hands. The glove provides aid in uphauling the rigging and does not hinder swimming. The glove may also be used without a harness if desired. The glove eliminates the need for a support strap.

It is possible and within the scope of the Applicant's invention to utilize the configuration of braces and straps described above without the use of a jacket means as shown generally in FIG. 4. The cross-shoulder brace 17' is placed over and supported essentially by the shoulders of the windsurfer, rather than attached to the upper back and shoulder area of the jacket means. Similarly, the rear-arm support braces 18' and 19' are supported largely by the connector straps 20' to the cross-shoulder brace. To further attach the rear-arm support braces to the arms of the windsurfer, the force redirect straps 24' and wristlet straps 25' may be used to encircle the forearms of the windsurfer, thereby transfering the force generated by the boom from the boom hook means 22' to the cross-shoulder brace. This effectively enables the windsurfer to utilize his weight in controlling the force generated by the boom as previously described.

It is contemplated within the scope of the Applicant's invention to incorporate herein various improvements, such as floatation devices, pads and the like. Similarly, the jacket means, straps, braces etc. may be of a color which is fashionable or brightly colored to render the user easily discernible when located in the water, thereby presenting a helpful safety feature.

Similar to the use of cushions or pads contained within the jacket means, air-containing devices or bladders may be utilized in the jacket means which are inflatable to render the windsurfing harness and the user more buoyant.

Having thus described the invention, many modifications thereto will become apparent to those skilled in the art to which it pertains without departing from the scope and spirit of the invention. Consequently, the scope of the application is not to be limited thereby.

I claim:

1. A windsurfing harness comprising:

a cross-shoulder brace;

at least two rear-arm support braces, each of said rear-arm support braces being attached to the cross-shoulder brace;

a plurality of forearm reinforcement or support straps, each such forearm reinforcement strap being attached to at least one of the rear-arm support braces;

a plurality of wrist attachment straps, each such wrist attachment strap being attached to at least one forearm reinforcement strap;

at least two hooks for attaching at least one forearm reinforcement strap to a bar-shaped member, each of said hooks including a top surface and an undersurface, said top surface including a knob;

and two force rotation assemblies for stablizing forces applied to said windsurfing harness.

2. The windsurfing harness of claim 1 wherein said undersurface includes at least one ridge, said at least one ridge protruding from said undersurface.

3. The windsurfing harness of claim 1 wherein said undersurface is of a double concave design with a V-shaped protrusion between said two concavities.

4. The windsurfing harness of claim 1, and further comprising a jacket means to which at least one of the cross-shoulder brace, rear-arm support braces, forearm reinforcement straps, hooks, and force rotation assemblies is attached.

5. The windsurfing harness of claim 1 wherein said force rotation assemblies comprise at least two force redirect straps, each of said force redirect straps attached to at least one forearm reinforcement strap.

6. The windsurfing harness of claim 1, and further comprising a ring for accommodating a support strap located at the rear of said hooks.

7. A windsurfing harness comprising:

a cross-shoulder brace;

at least two rear-arm support braces, each of said rear-arm support braces being attached to the cross-shoulder brace;

a plurality of forearm reinforcement or support straps, each such forearm reinforcement strap being attached to at least one of the rear-arm support braces;

a plurality of wrist attachment straps, each such wrist attachment strap being attached to at least one forearm reinforcement strap;

at least two hooks for attaching at least one forearm reinforcement strap to a bar-shaped member;

a hook retraction system comprising at least two support rings, each support ring capable of surrounding one of said hooks and said forearm reinforcement or support straps; and two force rotation assemblies for stabilizing forces applied to said windsurfing harness.

8. The windsurfing harness of claim 7, and further comprising at least two shock cords, each of said shock cords connecting one of said hooks to said harness and being surrounded by one of said support rings.

9. The windsurfing harness of claim 7, and further comprising a jacket means to which at least one of the cross-shoulder brace, rear-arm support braces, forearm reinforcement straps, hooks, and force rotation assemblies is attached.

10. The windsurfing harness of claim 7 wherein said force rotation assemblies comprise at least two force redirect straps, each of said force redirect straps attached to at least one forearm reinforcement strap.

11. The windsurfing harness of claim 7, and further comprising a ring for accommodating a support strap located at the rear of each of said hooks.

12. A windsurfing harness comprising:

a cross-shoulder brace;

at least two rear-arm support braces, each of said rear-arm support braces being attached to the cross-shoulder brace;

a plurality of forearm reinforcement or support straps, each such forearm reinforcement strap being attached to at least one of the rear-arm support braces;

a plurality of wrist attachment straps, each such wrist attachment strap being attached to at least one forearm reinforcement strap;

two gloves for attaching at least one forearm reinforcement strap to a bar-shaped member; and two force rotation assemblies for stabilizing forces applied to said windsurfing harness.

13. The windsurfing harness of claim 12 wherein each of said gloves comprises a top surface and an undersurface, and finger portions wherein said undersurface is comprised of a flexible rubber material adapted for gripping, and the undersurface of the thumb portion and at least a portion of the top surface of at least one of the other finger portions is covered with a hook and pile closure means.

14. The windsurfing harness of claim 12, and further comprising a jacket means to which at least one of the cross-shoulder brace, rear-arm support braces, forearm reinforcement straps, gloves, and force rotation assemblies is attached.

15. The windsurfing harness of claim 12 wherein said force rotation assemblies comprise at least two force redirect straps, each of said force redirect straps attached to at least one forearm reinforcement strap.

* * * * *